US007798885B2

(12) United States Patent
Wong et al.

(10) Patent No.: US 7,798,885 B2
(45) Date of Patent: Sep. 21, 2010

(54) INSTANT MESSAGE TOY PHONE

(75) Inventors: Andrew Wong, Torrance, CA (US); Ahmad A. Asbaghi, El Segundo, CA (US); Cassidy Park, Palos Verdes, CA (US); Catherine Demas, Rancho Palos Verdes, CA (US)

(73) Assignee: Mattel, Inc., El Segundo, CA (US)

( * ) Notice: Subject to any disclaimer, the term of this patent is extended or adjusted under 35 U.S.C. 154(b) by 1421 days.

(21) Appl. No.: 11/197,913

(22) Filed: Aug. 4, 2005

(65) Prior Publication Data

US 2006/0079147 A1 Apr. 13, 2006

Related U.S. Application Data

(60) Provisional application No. 60/598,945, filed on Aug. 4, 2004.

(51) Int. Cl.
*A63H 33/30* (2006.01)

(52) U.S. Cl. ..... 446/142; 446/139; 446/141

(58) Field of Classification Search ..... 446/142
See application file for complete search history.

(56) References Cited

U.S. PATENT DOCUMENTS

| | | | | |
|---|---|---|---|---|
| 3,702,515 | A * | 11/1972 | Beasley et al. | 446/142 |
| 3,742,645 | A * | 7/1973 | Casey | 446/139 |
| 3,757,463 | A | 9/1973 | Breslow et al. | |
| 3,793,766 | A * | 2/1974 | Moquin et al. | 446/142 |
| 4,158,931 | A * | 6/1979 | Terzian | 446/142 |
| 4,973,285 | A | 11/1990 | Diotte | |
| 5,183,431 | A | 2/1993 | Todokoro | |
| 5,474,484 | A * | 12/1995 | Lemelle | 446/142 |
| 5,855,483 | A * | 1/1999 | Collins et al. | 434/322 |
| 5,873,765 | A | 2/1999 | Rifkin et al. | |
| D409,688 | S | 5/1999 | Lee | |
| D410,046 | S | 5/1999 | Fletcher | |
| 5,984,758 | A | 11/1999 | Driska et al. | |
| 6,110,000 | A | 8/2000 | Ting | |
| 6,227,966 | B1 | 5/2001 | Yokoi | |
| 6,264,523 | B1 | 7/2001 | Simmons | |
| 6,302,796 | B1 | 10/2001 | Lebensfeld et al. | |
| 6,452,588 | B2 | 9/2002 | Griffin et al. | |

(Continued)

FOREIGN PATENT DOCUMENTS

DE 20012079 U1 * 6/2001

(Continued)

*Primary Examiner*—Ronald Laneau
*Assistant Examiner*—Tramar Harper
(74) *Attorney, Agent, or Firm*—Kolisch Hartwell, P.C.

(57) ABSTRACT

A wireless toy phone system that may be used with toy figures, such as dolls. The system may include doll sized phones and child sized phones. The child sized phone may have a display screen and input buttons. A child can compose a message with a phone keypad on the child's phone and send the message to another child sized phone, which will display the message. The phone may also receive messages from other child sized phones. The child may also be able to send a message to a doll sized phone associated with a doll or other figure, and the doll sized phone may respond with lights or sounds or both. The child sized phone may then compose a response that is displayed on the child sized phone simulating a return message from the doll.

22 Claims, 4 Drawing Sheets

U.S. PATENT DOCUMENTS

| | | | | |
|---|---|---|---|---|
| 6,551,165 | B2 | 4/2003 | Smirnov | |
| 6,648,719 | B2 | 11/2003 | Chan | |
| 6,659,835 | B1 * | 12/2003 | Allen | 446/142 |
| 2002/0028697 | A1 | 3/2002 | Davies | |
| 2002/0077028 | A1 | 6/2002 | Nishimoto | |
| 2002/0128047 | A1 | 9/2002 | Gates | |
| 2002/0173219 | A1 | 11/2002 | Kilstrom | |
| 2002/0178163 | A1 | 11/2002 | Mayer | |
| 2002/0197930 | A1 | 12/2002 | Derraugh et al. | |
| 2003/0073456 | A1 | 4/2003 | Griffin et al. | |
| 2003/0119561 | A1 | 6/2003 | Hatch et al. | |

FOREIGN PATENT DOCUMENTS

| | | |
|---|---|---|
| EP | 0 460 946 | 12/1991 |
| GB | 2 306 120 | 4/1997 |
| JP | 2003033585 | 2/2003 |
| WO | WO01/12285 | 2/2001 |
| WO | WO03/007583 | 1/2003 |

* cited by examiner

INSTANT MESSAGE TOY PHONE

CROSS-REFERENCES

This application claims priority to U.S. Provisional Patent Application Ser. No. 60/598,945, filed Aug. 4, 2004, and entitled "Instant Message Toy Phone," incorporated herein by reference.

BACKGROUND

The present disclosure relates generally to electronic toys, and more specifically to electronic toys that may be configured for interactive communication between users of the toys.

Examples of intercommunication toys are found in U.S. Pat. Nos. 3,542,515; 3,742,505; 3,757,463; 3,793,766; 4,158,931; 4,973,285; 5,183,431; 5,873,765; 5,974,758; 6,110,000; 6,207,966; 6,250,523; 6,302,796; 6,452,578; 6,551,165; 6,508,719; 6,659,835; D409,528; and D410,046; and in published patent application Nos. US2002/0027697; US2002/0075428; US2002/0127047; US2002/0173219; US2002/0197930; US2003/0073456; US2003/0119561; EP0460946A2; JP02003/033585A; and GB2,306,120. The disclosures of all of these patents and patent applications are incorporated herein by reference.

SUMMARY

The present disclosure relates to a toy messaging system that may include one or more toy telephones for use by one or more users. Each telephone (phone) may be configured to send and/or receive messages via infrared, visual light, radio frequency, or other wireless communication mode. The messages sent from one toy phone to another toy phone may include or represent text messages, graphic messages, or a combination of both text and graphic images. A message sent by one toy phone and received at another toy phone may be displayed on a screen of the toy phone receiving the message.

Furthermore, one or more toy telephones sized to match a doll may be included in the system. A message sent from a user's toy phone to the doll phone may result in an indication at the doll phone of a received message, such as by the generation of a tone or illumination of a flashing light. A message sent to the doll phone from the user's toy phone also may cause a simulative response message to be generated within the toy phone and displayed on the screen.

In some examples, the toy phone system may provide for interactive communication between two or more human users. In other examples, the toy phone system may provide for simulative interactive communication between a human user and a doll toy.

Appendix A is a list of icons, and their associated meanings, which may be used in the composition of a message to be sent between two toy telephones.

Appendix B is a list of phrases, one of which may be used as the response to a message sent from a user phone to a doll phone.

DETAILED DESCRIPTION

Figure 1:
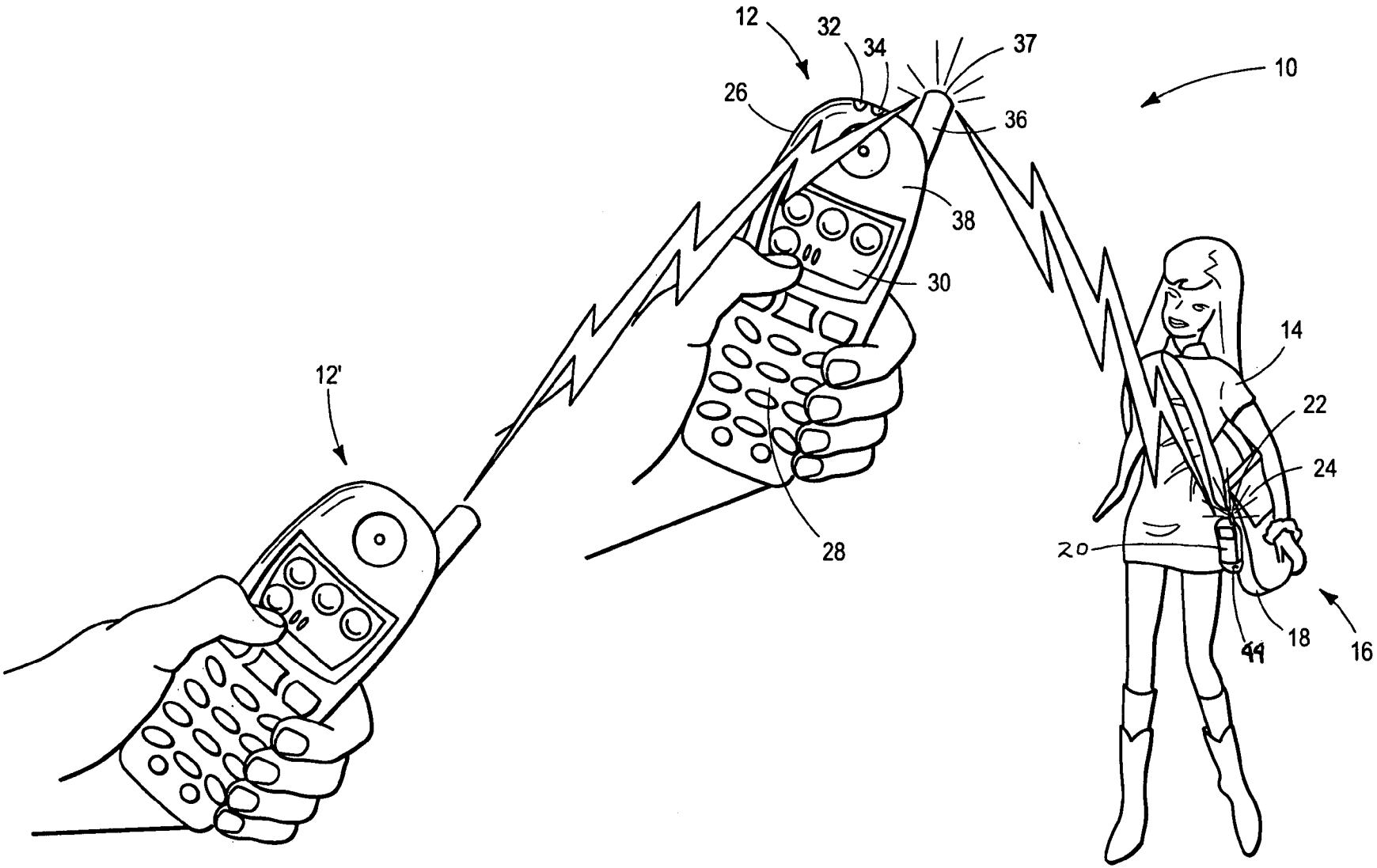
FIG. 1 is a perspective view of a toy messaging system including two user phones and one doll phone, with each user phone shown in a child's hand, and the doll phone shown in a shoulder bag supported on a doll.

Referring to FIG. 1, a toy messaging system shown generally at 10, may include one or more user phones 12 and 12', a doll 14 and a simulative cell phone accessory 16 including a doll bag or shoulder bag 18 and a doll phone 20. Doll phone 20 may have a simulative phone antenna 22 containing an indicator light 24. Each user phone 12 may have a phone body 26 that may support a keypad 28, a display screen 30, a wireless signal emitter 32, a signal detector 34, a simulative antenna 36, an indicator light 37 and a faceplate 38.

Figure 2:
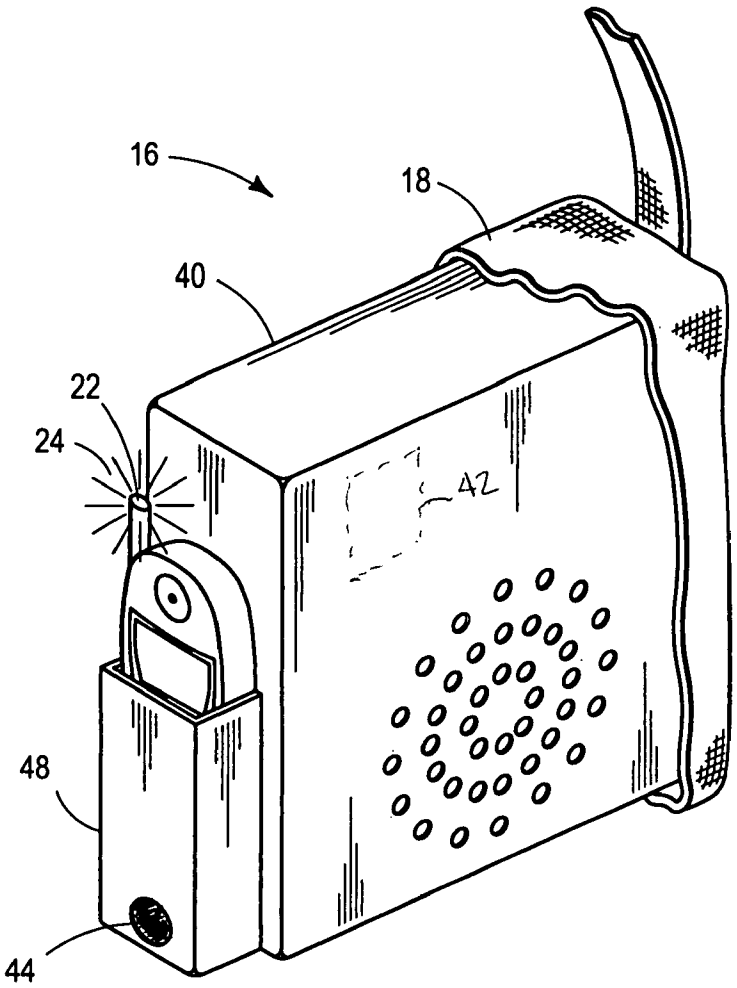
FIG. 2 is an isometric view of the shoulder bag and doll phone of FIG. 1, with the shoulder bag substantially cutaway to show a toy phone receiver, and with the doll phone positioned in a doll phone pocket.

Referring to FIG. 2, accessory 16 is shown supported in shoulder bag 18, which bag is shown in cutaway view. Cell phone accessory 16 includes a receiver 40, to which doll phone 20 connects. Receiver 40 may include a logic circuit 42, represented by dashed lines, a detector 44 and a speaker 46. Doll phone 20 is shown positioned in pocket 48 with indicator light 24 activated, as represented by a starburst of lines.

Figure 3:
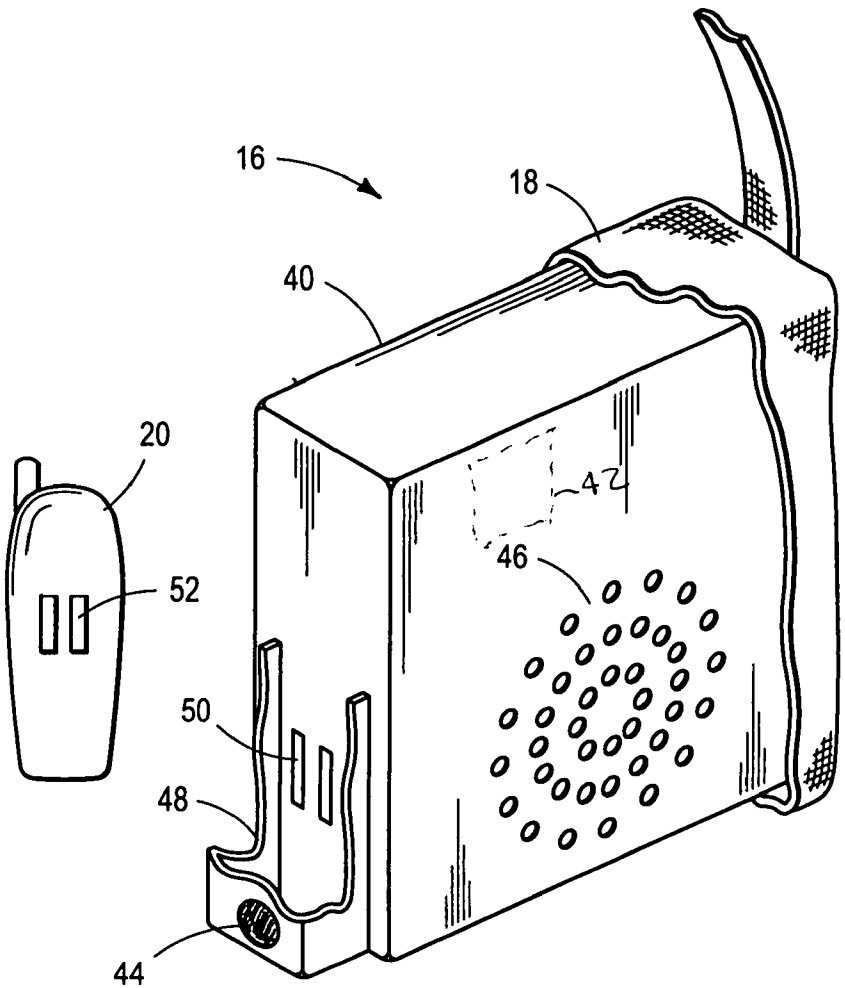
FIG. 3 is an isometric view of the shoulder bag and doll phone of FIG. 2, with the doll phone pocket substantially cutaway to show a pair of exposed receiver contacts, and with the doll phone removed and flipped upside down to show a pair of exposed doll phone contacts on the back of the doll phone.

Referring to FIG. 3, receiver 40 is shown with pocket 48 partially cutaway to show exposed contacts 50 on a side of receiver 40. Doll phone 20 is shown flipped over to show corresponding exposed phone contacts 52. Receiver 40 may contain all the electronics necessary to simulate the reception of a message by doll phone 20. Shoulder bag 18 may have a side panel made of an open mesh fabric which may partially cover detector 44 on receiver 40.

As represented symbolically in FIG. 1, user phone 12 may function as a transceiver with both transmit and receive functionality. In this embodiment, user phone 12 may transmit a wireless signal from emitter 32 which may be detected at detector 44 in doll bag 18. Alternatively, or additionally, a first transceiver 12 can send text and/or symbol messages to a second transceiver 12' with the message appearing on screen 30 of the second transceiver.

Screen 30 may be configured to display feedback messages in response to actions by the user. For example, a user may push keys on body keypad 28 causing a moving image to be displayed on screen 30. Alternatively, or additionally, a user may push keys to cause a static image to be displayed on screen 30. The keys of body keypad 28 may include number and/or text keys, and a "Send" key, and the static images may include one or more icons and/or text characters used during the composition of an instant message. Such keys and static images are well known in the art, but are described in detail below.

A message may be composed by a user by using the keys to move progressively through a list of selectable icons or selectable text characters on screen 30 as choices are displayed. This may occur, for example, using keys on keypad 28 to display the icons on screen 30. An exemplary list of text characters and visual icons, which may be presented for selection during the composition of an instant message, is provided in Appendix A.

Antenna 36 and screen 30 of user phone 12 may be configured to provide feedback to the user of the toy. For example, user phone antenna 36 may include an indicator light 37 which is activated during sending a message to or receiving a message from another toy phone. For example, antenna 36 may periodically project a colored light when a new message has been received from a user phone 12 of another user. The colored light may be, for example, a red light, a blue light, a green light, or other color light.

Figure 5:
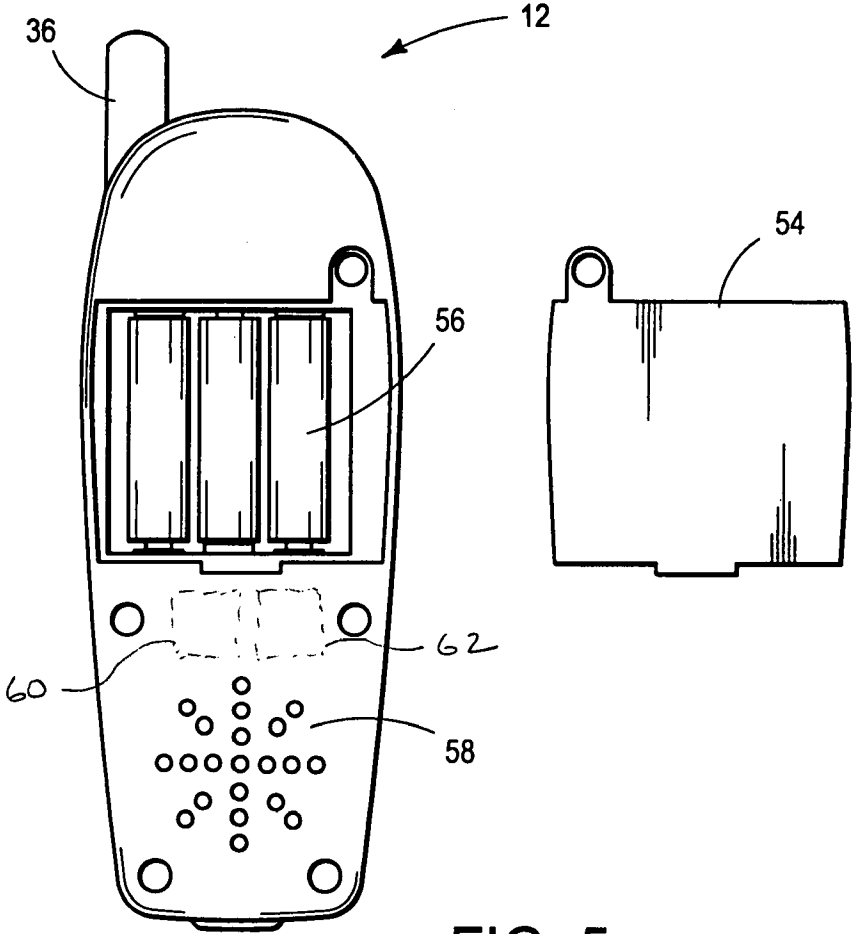
FIG. 5 is a perspective view of the back of the user phone of FIG. 4, with a battery cover removed to show batteries contained in the user phone.
Figure 4:
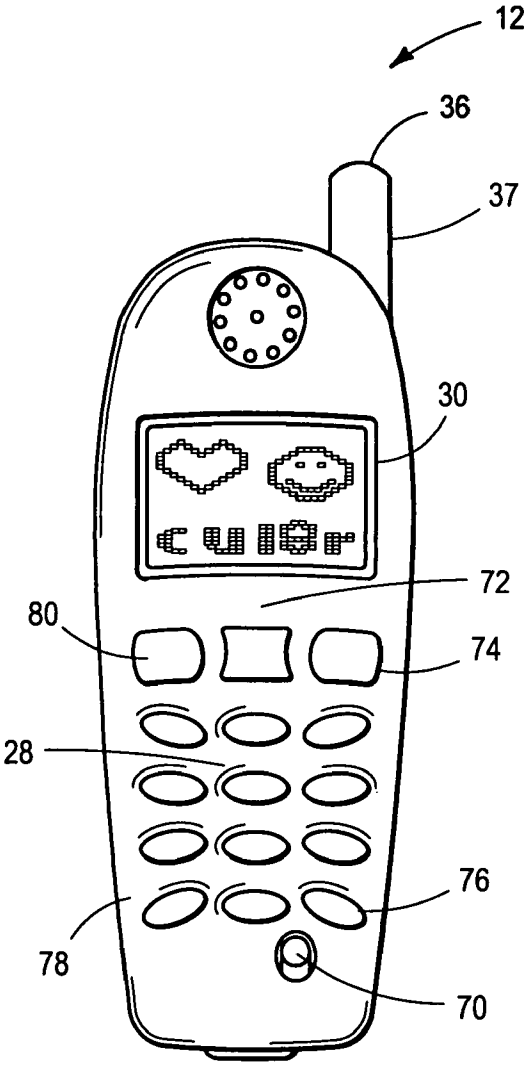
FIG. 4 is a perspective view of the front of one of the user phones of FIG. 1, showing functional keys, a screen and other details.

FIGS. 4 and 5 show user phone 12 in more detail, including keypad 28, screen 30, antenna 36 and indicator light 37 on the front of user phone 12, and on the back, a removable access panel 54 that retains batteries 56 in a battery compartment. Batteries 56 may provide the energy source for the electronics of user phone 12. Phone 12 also may have a speaker 58. Phone body 26 also may enclose a logic circuit 60 and memory 62, represented by dashed lines. Memory 62 may store a program executed by the logic circuit 60, as well as data used during communication, such as text and icons.

Figure 6:
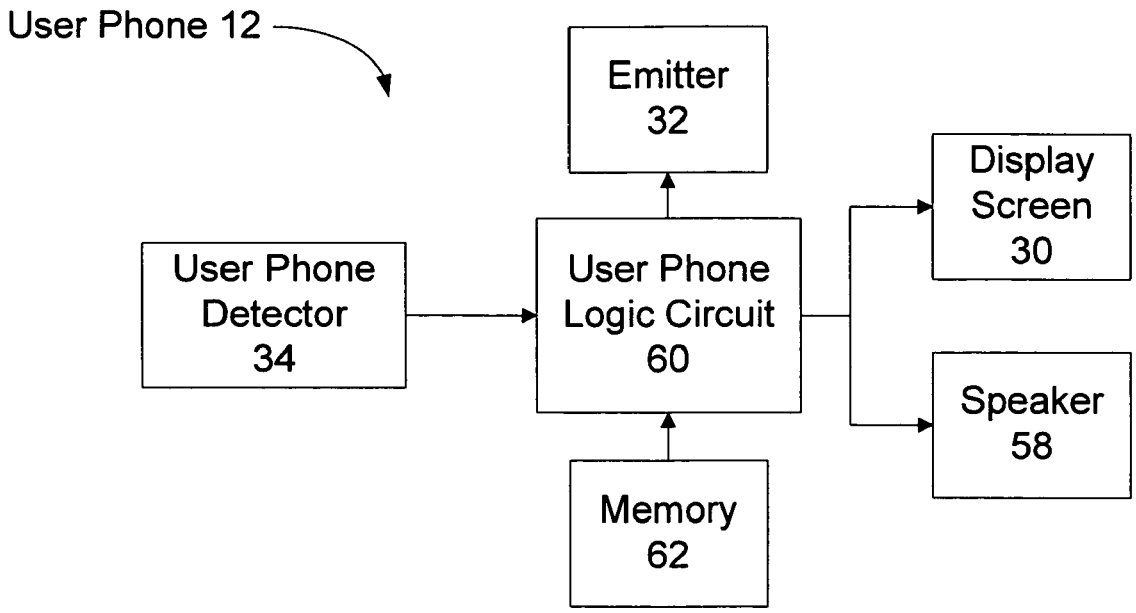
FIG. 6 is a block diagram of the user phone of FIGS. 4 and 5, showing electrical components of the user phone.

FIG. 6 shows a block diagram of electrical components in user phone 12. User phone 12 may have a logic circuit 60 operably connected to display screen 30, emitter 32, detector 34, speaker 58 and memory 62.

Figure 7:
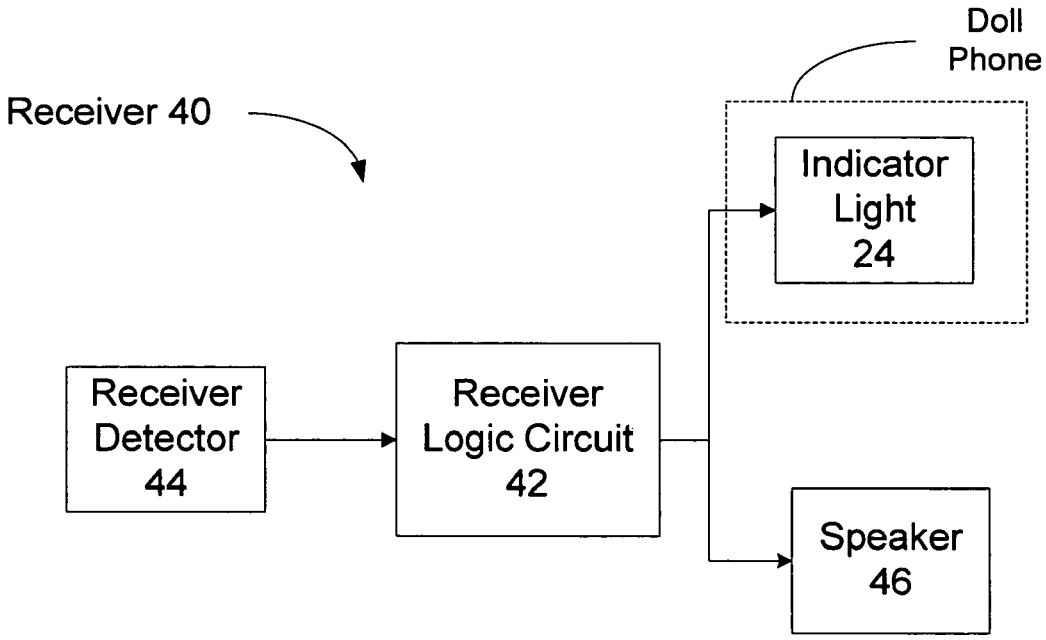
FIG. 7 is a block diagram of the receiver and the doll phone of FIGS. 2 and 3, showing electrical components of the receiver and the doll phone.

FIG. 7 shows a block diagram of electrical components in receiver 40. Receiver 40 may have logic circuit 42 operably connected to indicatory light 24, detector 44 and speaker 46.

Receiver detector 44 may function as a communication link between user phone 12 and receiver 40. Upon receipt of a wireless signal by receiver 40 from user phone 12, receiver 40 may respond by producing an audible notification action through logic circuit 42. The audible notification action may take the form of a ringing sound, musical tone, or other appropriate sound, produced from integral speaker 46 in receiver 40. In addition, receiver 40 may respond to receipt of a wireless signal by performing a visual notification action through logic circuit 42. Such a visual notification action may include flashing indicator light 24 in doll phone simulative antenna 22 when receiver contacts 50 are in contact with phone contacts 52.

In some examples, doll phone 20 may not contain electronic components. Doll phone 20 may only be an inanimate toy made into the shape of a phone, and configured to reside in a pocket 48 on the side of receiver 40.

Successful transmission of an instant message from a first toy phone to a second toy phone may require that the telephones be within a given distance of each other depending on the mode of wireless communication used. When user phone 12 of an intended recipient of an instant message is within range of the message sender's toy phone, depressing a key on keypad 28 may send the instant message to the chosen toy phone device.

Communication may be between a wireless emitter 32 of a first user phone and a wireless signal detector 34 of a second user phone, or receiver detector 44. The wireless signals may be modulated, such as visible light encoded in an Amplitude Shift Keying protocol or the signals could be coded infrared or radio frequency signals. In the case of a radio frequency signal, the emitters and detectors may be radio antennas.

The step of selecting a receiver to receive the message or signal may be choosing an item from the display screen 30. The step of selecting a receiver to receive the message or signal may be pointing the user phone at a receiver.

Once a message is sent from a first toy phone to a second toy phone, the second toy phone may receive the message. The receipt of an instant message by a toy phone may cause that phone to make a visual or audible signal to notify the user of that phone that an instant message has been received. The audible signal may take any suitable form, such as a ringing noise, a beeping noise, or a musical tune, any of which may be output from user phone speaker 58. The visual signal may take any suitable form, such as a flashing icon or text message on display screen 30, an illuminated indicator light 37 in the tip of antenna 36, or the like. Optionally, user phone 12 may be configured to produce another form of silent signal that denotes a received message; this might be the case, for example, if the phone is configured to vibrate when a message is received.

Upon receipt of an instant message, the user of a second toy phone may respond to the user of the first toy phone. The second user may input a response instant message into the second phone in a manner which may be similar to that followed by the first user, and transmit that message to the phone of the first user. The receipt of a transmitted message may cause the phone of the first user to make an audible ringing noise, audible musical notes, a visual signal, a silent signal, or other appropriate signal, such as is discussed above. The user may be able to configure the phone to use a preferred signal on receiving a message.

The above pattern of sending and receiving messages using toy telephones may continue at the discretion of the users of the phones.

The procedure to be followed for sending a message to doll phone 20 associated with a toy doll may follow generally the same steps as outlined above with respect to sending a message to user phone 12 of a second user. User phone 12 may have more complex logic functions in order to simulate responses from doll phone 20. In the first part of a simulative conversation between a human user and a toy doll, the human user may compose and send a message on a user phone 12 according to the above-described process. The human user may choose the doll as the intended recipient of the composed instant message. Sending an instant message to doll phone 20 may cause receiver 40 associated with doll phone 20 to perform the notification actions as described for user phone 12 of a human user. The receipt of a transmitted message may cause receiver 40 associated with doll phone 20 to make an audible ringing noise, audible musical notes, a visual signal, a silent signal, etc.

Sending a message from user phone 12 to doll phone 20 may activate a specific program in the logic circuit 60 of user phone 12. User phone 12 may include a timing device and a "doll response" device. The timing device in user phone 12 may be activated when a doll phone is chosen as the target of an instant message. The timing device may count down from, for example, 30 seconds before activating a "doll response" within the same toy phone.

Upon the expiration of a suitable length of time, a "doll response" may be displayed upon display screen 30 of user phone 12. The content of the response from the doll may be determined by a software component within logic circuit 60 of user phone 12. The software in the logic circuit 60 may search for key phrases in the instant message which was sent to doll phone 20. For example, the software may search for the text string "2day?", or for "bff!", etc. If the software finds a relevant text string in the message, then the software may use that text string as the basis for selecting a response from memory 62 that apparently comes from the doll. Exemplary responses which may seem to be sent from the doll in response to a message from a human user are given in Appendix B. The listed responses are only meant to give suggestions as to possible responses; many other instant-message phrases and their associated responses may be used.

Finally, referring back to FIG. 4, the functional keys of keypad 28 may include a single Power On/Off key 70 and/or separate keys for turning user phone 12 power on or off. A number of keys may be included and used to compose, proof, and/or send a message. User phone 12 may be configured to contain: one or more scroll keys 72, an "OK" key 74, keys 26 for the numbers zero through nine, a tone key 76, a delete key 78, and/or a "Send" key 80. This is an example of keys that may be available. There may be more or fewer keys available and they may be in a different layout than that illustrated.

Furthermore, faceplate 38 may separably snap onto body 26 and provide a more aesthetically pleasing and variable appearance to user phone 12. Faceplate 38 may provide access to the keys on keypad 28 and screen 30 or may act as a cover, obscuring keyboard 28 and screen 30 to protect them from access and damage.

Although the present invention has been shown and described with reference to the foregoing operational principles and preferred embodiments, it will be apparent to those skilled in the art that various changes in form and detail may be made without departing from the spirit and scope of the invention. The present invention is intended to embrace all such alternatives, modifications and variances that fall within the scope of the appended claims.

APPENDIX A

Icons and Meanings

| ICON | MEANING |
|---|---|
| ☺ | smiley face |
| ☹ | sad face |
| ☻ | angry face |
| 😮 | shocked face |
| ♥ | heart |
| ♪♫ | music/dancing/concert |
| 🍕 | pizza |
| 🎥 | movie |
| 🏠 | home |
| @ | at |
| **2day** | today |
| **2nite** | tonight |
| **i'm** | i'm |
| **ru** | are you |
| **lol** | laughing out loud |
| **bff** | best friends forever |
| **cul8r** | see you later |
| **?** | question mark |
| **!!** | exclamation points |

APPENDIX B

Exemplary Doll Responses

Doll's possible replies to an instant message:

When message is received:
new msg
from
barbie
If the child wrote "bff":
yeah,
4eva!!

APPENDIX B-continued

Exemplary Doll Responses

Doll's possible replies to an instant message:

If the child asked a "2day" or "2nite" question:

| | | |
|---|---|---|
| sounds | can't . . . | |
| cool!! | busy | |

If the child asked a generic yes/no question or wrote "r u" . . . :

| | | |
|---|---|---|
| yeah, | maybe | nope, |
| haha. | ☺ | i'm☻ |

If the child wrote "c u l8r":
cool,
l8r!!
Default:

| | | |
|---|---|---|
| ☻ | ☺ | how |
| | | r u? |

We claim:

1. A toy messaging system comprising:
a user phone including an emitter for sending a signal;
a receiver including:
a pocket with receiver contacts which are exposed;
a logic circuit for receiving the signal and energizing the receiver contacts when the signal is received; and
a doll phone sized to fit in the pocket including:
phone contacts which are exposed and sized to mate with the receiver contacts; and
an indicator light operatively connected to the phone contacts;
wherein the indicator light in the doll phone may be activated by the logic circuit, through the receiver contacts and phone contacts.

2. The toy messaging system of claim 1 wherein:
the emitter includes an infrared LED; and
the receiver includes an infrared detector.

3. The toy messaging system of claim 1 wherein:
the emitter transmits visible light; and
the receiver includes an visible light detector.

4. The toy messaging system of claim 1 wherein the receiver is removably contained in a shoulder bag for a doll.

5. The toy messaging system of claim 4 wherein:
the doll phone is at least partially visible when the receiver is contained in the shoulder bag and the doll phone is mated with the receiver.

6. The toy messaging system of claim 1 wherein the doll phone is at least partially visible when the doll phone is mated with the receiver.

7. A receiver to be used in a messaging communication system with a transceiver, the receiver comprising:
a doll phone including an indicator light;
a detector for receiving a wireless signal;
a speaker; and
a carry bag sized for attachment to a doll;
wherein:
the doll phone is connected to the receiver;
the receiver is enclosed in the carry bag;
the indicator light in the doll phone may be activated by the receiver when the wireless signal is received; and
the doll phone is at least partially exposed when the receiver is in the carry bag and the doll phone is connected to the receiver.

8. The receiver of claim 7 wherein the detector responds to infrared light.

9. The receiver of claim 7 wherein the detector responds to visible light.

10. The receiver of claim 7 wherein the receiver responds to a signal received at the detector by emitting sound.

11. The receiver of claim 7 wherein the doll phone includes exposed contacts configured to connect with exposed contacts on the receiver.

12. The receiver of claim 7 wherein the doll phone responds to the receiver by emitting light.

13. A simulative communication system comprising:

a transceiver; and a receiver comprising:

exposed receiver contacts;

a logic circuit for energizing the receiver contacts;

a doll phone including an indicator light and exposed phone contacts which are sized to mate with the receiver contacts;

a detector for receiving a wireless signal; and a speaker;

wherein the indicator light in the doll phone may be activated by the receiver, when the wireless signal is received, through the receiver contacts and the phone contacts.

14. The simulative communication system of claim 13 wherein the receiver is removably contained in a shoulder bag for a doll.

15. The simulative communication system of claim 14 wherein:

the doll phone is at least partially visible when the receiver is contained in the shoulder bag and the doll phone is mated with the receiver.

16. The simulative communication system of claim 13 wherein the detector responds to infrared light.

17. The simulative communication system of claim 13 wherein the detector responds to visible light.

18. The simulative communication system of claim 13, further comprising:

an additional transceiver that transmits messages;

wherein the transceiver receives and displays the messages transmitted by the additional transceiver.

19. The simulative communication system of claim 18, wherein the transceiver transmits messages.

20. The simulative communication system of claim 13 wherein the transceiver includes an infrared emitter and the receiver includes an infrared detector.

21. The simulative communication system of claim 13 wherein the transceiver includes a visible light emitter and the receiver includes a visible light detector.

22. The simulative communication system of claim 13 wherein: the transceiver includes memory; and a simulative response message is stored on the memory.

* * * * *